US010720137B1

(12) United States Patent
Hall et al.

(10) Patent No.: US 10,720,137 B1
(45) Date of Patent: Jul. 21, 2020

(54) METHODS AND SYSTEMS FOR MODIFYING SOUND WAVES PASSING THROUGH A WALL

(71) Applicant: Hall Labs, LLC, Provo, UT (US)

(72) Inventors: David Hall, Provo, UT (US); Benjamin Jensen, Orem, UT (US); Andrew Priddis, Mapleton, UT (US); Nathan Davis, Bountiful, UT (US)

(73) Assignee: Hall Labs LLC, Provo, UT (US)

( * ) Notice: Subject to any disclaimer, the term of this patent is extended or adjusted under 35 U.S.C. 154(b) by 0 days.

(21) Appl. No.: 16/396,599

(22) Filed: Apr. 26, 2019

(51) Int. Cl.

| | |
|---|---|
| ***H04R 3/02*** | (2006.01) |
| ***G10K 11/175*** | (2006.01) |
| ***H04R 17/02*** | (2006.01) |
| ***H04R 1/02*** | (2006.01) |
| ***H04R 29/00*** | (2006.01) |

(52) U.S. Cl.
CPC ..... *G10K 11/175* (2013.01); *H04R 1/025* (2013.01); *H04R 17/02* (2013.01); *H04R 29/001* (2013.01); *H04R 2430/01* (2013.01)

(58) Field of Classification Search
CPC ..... G10K 11/175; H04R 1/025; H04R 17/02; H04R 29/001
See application file for complete search history.

(56) References Cited

U.S. PATENT DOCUMENTS

| | | | | |
|---|---|---|---|---|
| 5,652,798 | A * | 7/1997 | Mizushima | H04S 7/305 381/63 |
| 7,006,639 | B2 * | 2/2006 | Hobelsberger | F16L 55/0333 381/71.5 |
| 9,856,643 | B1 * | 1/2018 | Lytle | E04C 2/20 |
| 2003/0107478 | A1 * | 6/2003 | Hendricks | G10K 11/175 340/311.2 |
| 2004/0151326 | A1 * | 8/2004 | Nishimura | G10K 11/178 381/71.2 |
| 2008/0007911 | A1 * | 1/2008 | Hallin | G06F 1/181 361/679.47 |
| 2018/0268802 | A1 * | 9/2018 | Urhonen | G10K 11/178 |
| 2018/0268840 | A1 * | 9/2018 | Krasnov | G10K 11/175 |
| 2019/0208352 | A1 * | 7/2019 | Trestain | G01H 7/00 |

* cited by examiner

*Primary Examiner* — Simon King

(57) ABSTRACT

Methods and systems for modifying ambient sound waves passing through a wall are disclosed. The wall has a first side and a second side with a cavity therebetween. A sound producing device is situated between the first side and the second side and is configured to produce interfering sound waves in the cavity such that the sound waves passing through the wall are reduced, masked, or reduced and masked.

18 Claims, 4 Drawing Sheets

METHODS AND SYSTEMS FOR MODIFYING SOUND WAVES PASSING THROUGH A WALL

TECHNICAL FIELD

This application relates generally to the field of sound modification.

BACKGROUND

Sound propagation across walls is often a nuisance. In addition, privacy concerns can arise from overhearing conversations through thin walls. City sounds keep people awake. Loud music can drive parents to distraction, even through thicker walls. Passive sound reduction techniques, including thickening walls and using special sound dampening materials, can only reduce or muffle sounds so much. Active sound reduction techniques are desired but are sometimes expensive or ineffective. Methods and systems for modifying sound waves passing through a wall are needed.

SUMMARY

In a first aspect, the disclosure provides a system for modifying ambient sound waves passing through a wall. The wall has a first side and a second side with a cavity therebetween. A sound producing device is situated between the first side and the second side and is configured to produce interfering sound waves in the cavity such that the sound waves passing through the wall are reduced, masked, or reduced and masked.

In a second aspect, the disclosure provides a method for modifying ambient sound waves passing through a wall. A wall with a first side and a second side is provided. The wall has a cavity therebetween. The sound waves are received on one side of the wall. Interfering sound waves are generated by a sound producing device in the cavity such that the sound waves passing through the wall are reduced, masked, or reduced and masked.

In a third aspect, the disclosure provides a system for modifying ambient sound waves passing through a wall. The wall has a first side and a second side with a cavity between the first side and the second side. A first sound detection device is configured to detect a first decibel level outside of the first side and to transmit first information about the first decibel level to a controller. A second sound detection device is configured to detect a second decibel level outside of the second side and to transmit second information about the second decibel level to the controller. The controller is configured to receive the first information and the second information and to send a signal to a sound producing device. The sound producing device, situated between the first side and the second side, is configured to receive the signal and to produce interfering sound waves in the cavity based on the first information and the second information such that sound waves passing through the wall are reduced, masked, or reduced and masked.

Further aspects and embodiments are provided in the foregoing drawings, detailed description and claims.

BRIEF DESCRIPTION OF THE DRAWINGS

The following drawings are provided to illustrate certain embodiments described herein. The drawings are merely illustrative and are not intended to limit the scope of claimed inventions and are not intended to show every potential feature or embodiment of the claimed inventions. The drawings are not necessarily drawn to scale; in some instances, certain elements of the drawing may be enlarged with respect to other elements of the drawing for purposes of illustration.

DETAILED DESCRIPTION

Figure 1:
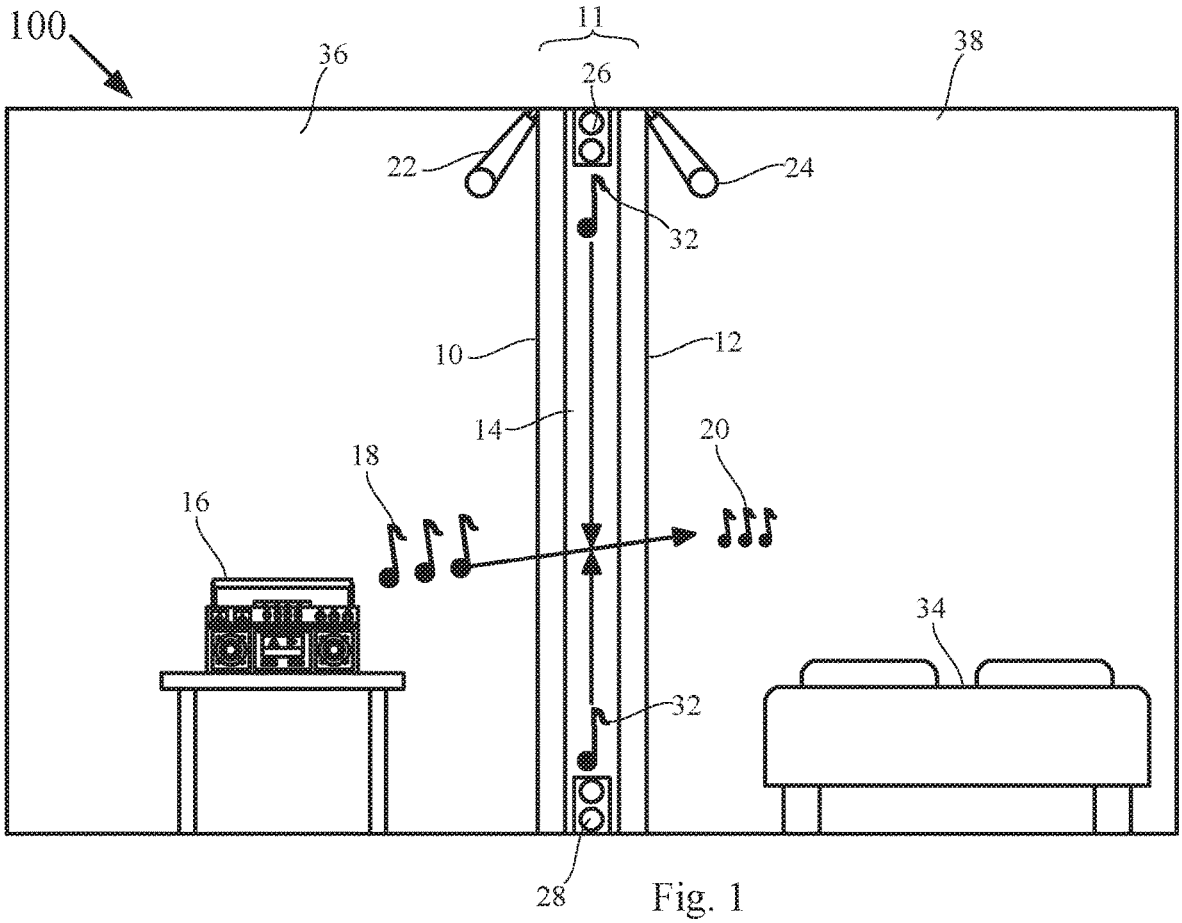
FIG. 1 is an elevation view of the interior of two rooms separated by a wall.

The following description recites various aspects and embodiments of the inventions disclosed herein. No particular embodiment is intended to define the scope of the invention. Rather, the embodiments provide non-limiting examples of various compositions, and methods that are included within the scope of the claimed inventions. The description is to be read from the perspective of one of ordinary skill in the art. Therefore, information that is well known to the ordinarily skilled artisan is not necessarily included.

Definitions

The following terms and phrases have the meanings indicated below, unless otherwise provided herein. This disclosure may employ other terms and phrases not expressly defined herein. Such other terms and phrases shall have the meanings that they would possess within the context of this disclosure to those of ordinary skill in the art. In some instances, a term or phrase may be defined in the singular or plural. In such instances, it is understood that any term in the singular may include its plural counterpart and vice versa, unless expressly indicated to the contrary.

As used herein, the singular forms "a," "an," and "the" include plural referents unless the context clearly dictates otherwise. For example, reference to "a substituent" encompasses a single substituent as well as two or more substituents, and the like.

As used herein, "for example," "for instance," "such as," or "including" are meant to introduce examples that further clarify more general subject matter. Unless otherwise expressly indicated, such examples are provided only as an aid for understanding embodiments illustrated in the present disclosure and are not meant to be limiting in any fashion. Nor do these phrases indicate any kind of preference for the disclosed embodiment.

As used herein, the term "speaker" refers to all types of speakers, such as an electrodynamic loudspeakers (or just "loudspeakers"), piezoelectric speakers, flat panel speakers, and plasma arc speakers.

As used herein, "masking" sounds is the process of adding background sound to reduce noise distractions, protect speech privacy, and increase office comfort.

As used herein, "reduced" sound waves are sound waves that have had their amplitude or decibel level reduced by destructive interference with interfering sound waves.

Ambient sound passing through a wall is often a nuisance. This is especially true for thin walls. In cases where there is a cavity between two sides of a wall, the present invention is able to modify the ambient sound waves such that they are reduced, masked, or both reduced and masked. A sound producing device, such as a speaker, is situated between the two sides of the wall and produce interfering sound waves in the cavity. The interfering sound waves reduce or mask the ambient sound waves. The interfering sound waves reduce the ambient sound waves by destructive interference between the interfering and ambient sound waves. The interfering sound waves mask the ambient sound waves by constructively interfering and destructively interfering with the ambient sound waves in a pattern that causes the frequency of sound to be indistinct and garbled by the time it passes through the wall.

Now referring to FIG. 1, FIG. 1 is an elevation view of the interior of two rooms 100 separated by a wall that may be used in one embodiment of the present invention. A first room 36 has a boom box 16 that produces music 18. A second room 38 contains a bed 34 on which a person may sleep. The second room 38 needs the music 18 to be reduced. A microphone 22 detects the decibel level and the sound frequency in the first room 36 while a microphone 24 detects the decibel level and the sound frequency in the second room 38. The wall 11 consists of a first side 10 and a second side 12 with a cavity 14 between the first side 10 and the second side 12. Speaker 26 is mounted on the ceiling between the first side 10 and the second side 12. Speaker 28 is mounted on the floor between the first side 10 and the second side 12. While the preferred embodiment uses two speakers, a single speaker or more than two speakers can be used.

The information regarding the decibel levels and sound frequencies is transmitted from the microphones 22 and 24 to a controller which determines that the decibel level is higher in the first room 36 and what the frequency of the sound to be reduced and masked is. The controller sends a signal to the speakers 26 and 28 to produce interfering sound waves 32 in the cavity 14 that reduce and mask the sound waves of music 18 by passing through the wall 11, resulting in a modified sound wave 20 in the second room 38.

In a preferred embodiment, the sound frequencies that are detected are audible frequencies, from 20 Hz to 20,000 Hz. In a more preferred embodiment, the sound frequencies that are detected are the frequencies the human voice covers, from 85 to 255 Hz.

In a preferred embodiment, the decibel levels detected and reduced range from 30 dB (roughly equivalent to a whisper) to 100 dB (roughly equivalent to a boom box). In a more preferred embodiment, the decibel levels detected and reduced range from 60 dB (roughly equivalent to a normal conversation) to 95 dB (roughly equivalent to a shouted conversation).

In a preferred embodiment, the speakers have an amplifier power capable of producing at least 100 dB.

Figure 2:
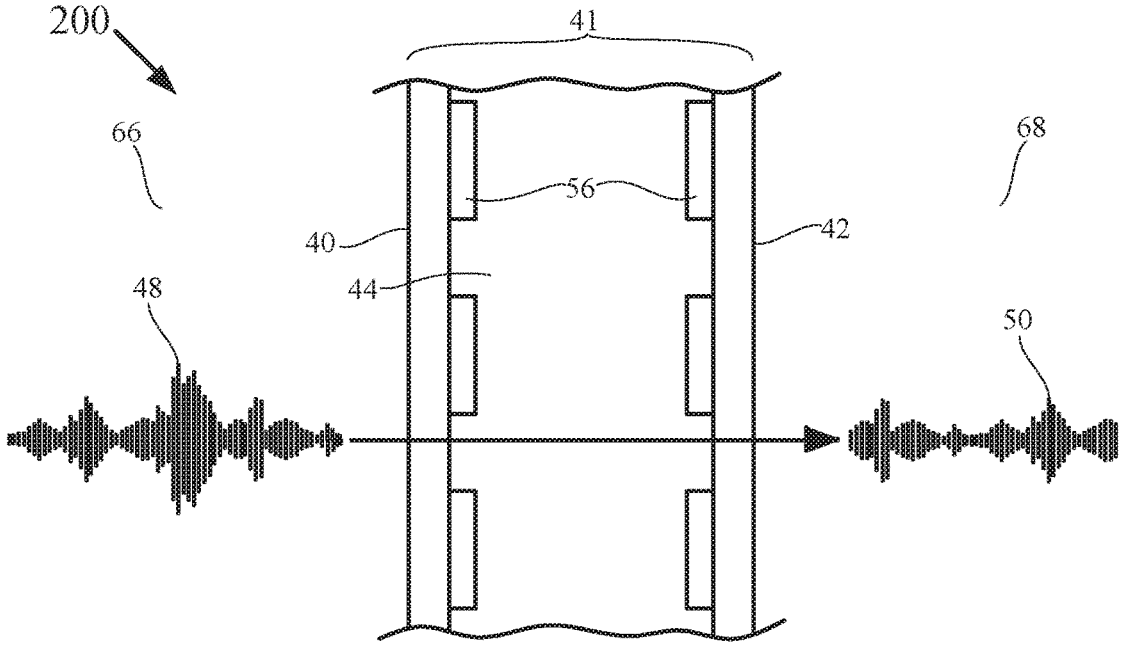
FIG. 2 is a close-up cross-sectional view of a wall separating two rooms.

Now referring to FIG. 2, FIG. 2 is a close-up cross-sectional view of a wall separating two rooms 200 that may be used in one embodiment of the present invention. A first room 66 has a person speaking regarding private matters, producing sound waves 48. A second room 68 is a waiting area. The wall 41 consists of a first side 40 and a second side 42 with a cavity 44 between the first side 40 and the second side 42. Vibrating devices 56 are mounted on the first side 40 and the second side 42. The vibrating devices 56 vibrate to produce interfering sound waves into the cavity 44 that mask the sound waves 48 passing through the wall 41, resulting in a masked sound wave 50 in the second room 68.

Figure 3:
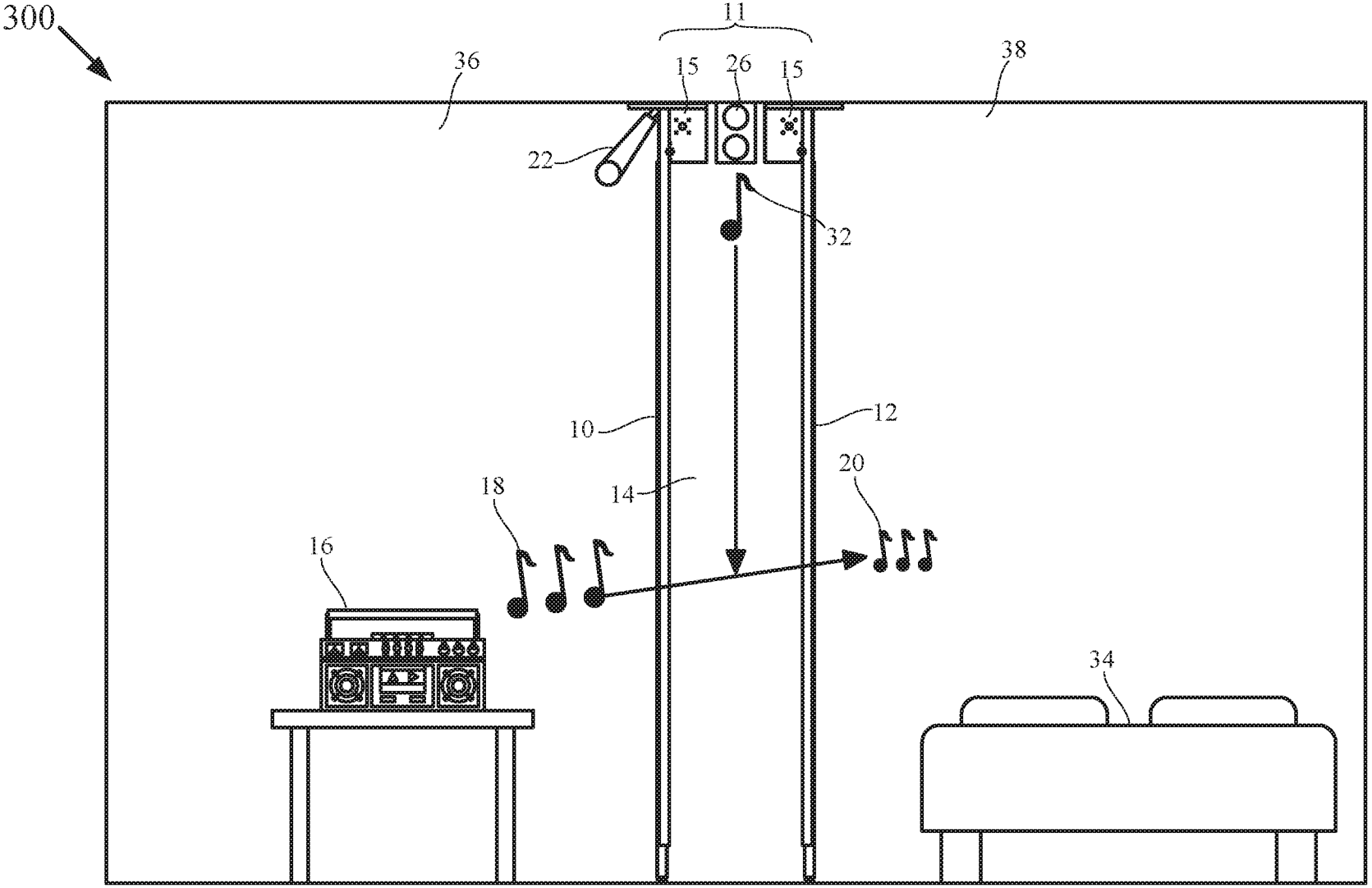
FIG. 3 is an elevation view of the interior of two rooms separated by a wall.

Now referring to FIG. 3, FIG. 3 is an elevation view of the interior of two rooms 300 separated by a retractable wall that may be used in one embodiment of the present invention. A first room 36 has a boom box 16 that produces music 18. A second room 38 contains a bed 34 on which a person may sleep. The second room 38 needs the music 18 to be reduced. A microphone 22 detects the decibel level in the first room 36. The wall 11 consists of a first side 10 and a second side 12 with a cavity 14 between the first side 10 and the second side 12. The first side 10 and the second side 12 are retractable upwards around spools 15. Speaker 26 is mounted on the ceiling between the first side 10 and the second side 12.

The information regarding the decibel level is transmitted from the microphone 22 to a controller which determines how the speakers 26 can best reduce, mask, or reduce and mask the sound waves of music 18. The controller sends a signal to the speaker 26 to produce interfering sound waves 32 in the cavity 14 that reduce the sound waves of music 18 passing through the wall 11, resulting in a reduced, masked, or reduced and masked sound wave 20 in the second room 38.

Figure 4:
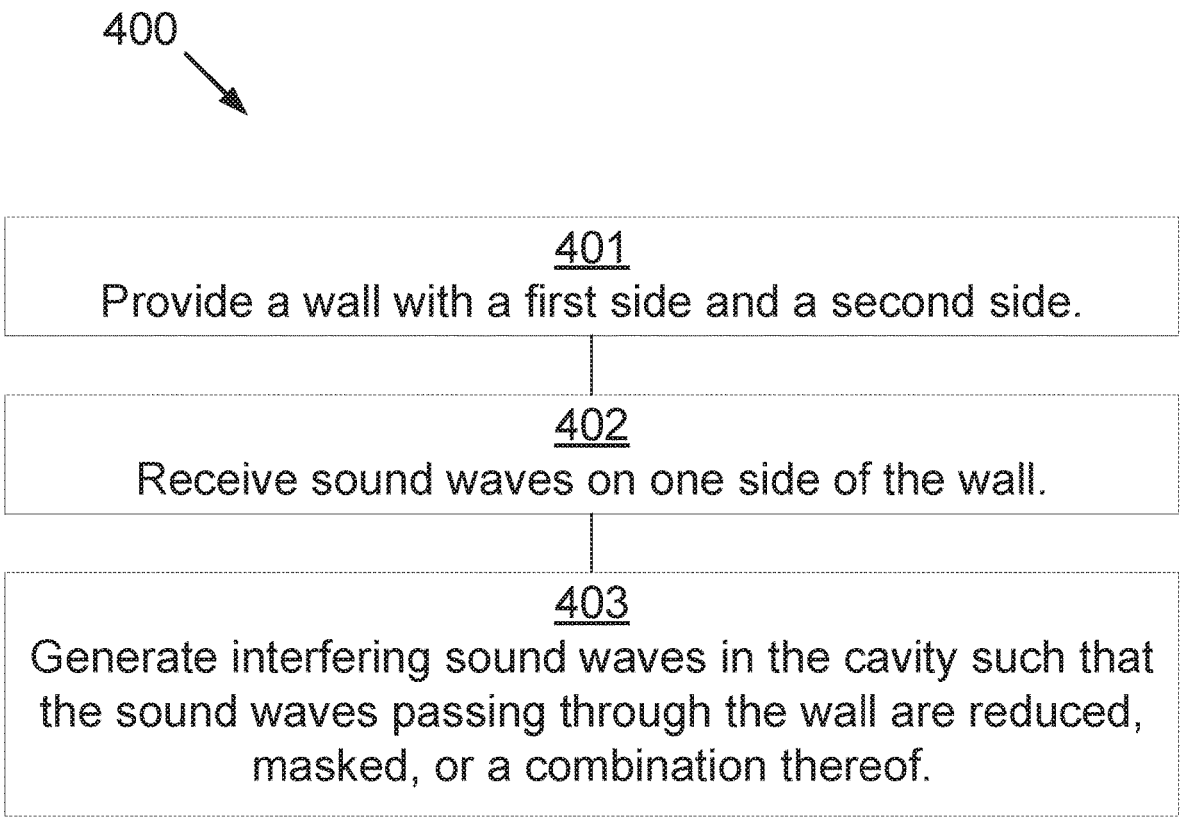
FIG. 4 is a block diagram showing a method for modifying sound waves passing through a wall.

Now referring to FIG. 4, FIG. 4 is a block diagram showing a method for modifying sound waves passing through a wall that may be used in a preferred embodiment of the present invention. At 401, a wall is provided with a first side and a second side. The wall has a cavity between the first side and the second side. At 402, sound waves are received on one side of the wall. At 403, interfering sound waves are generated in the cavity such that the sound waves passing through the wall are reduced, masked, or a combination thereof.

Figure 5:
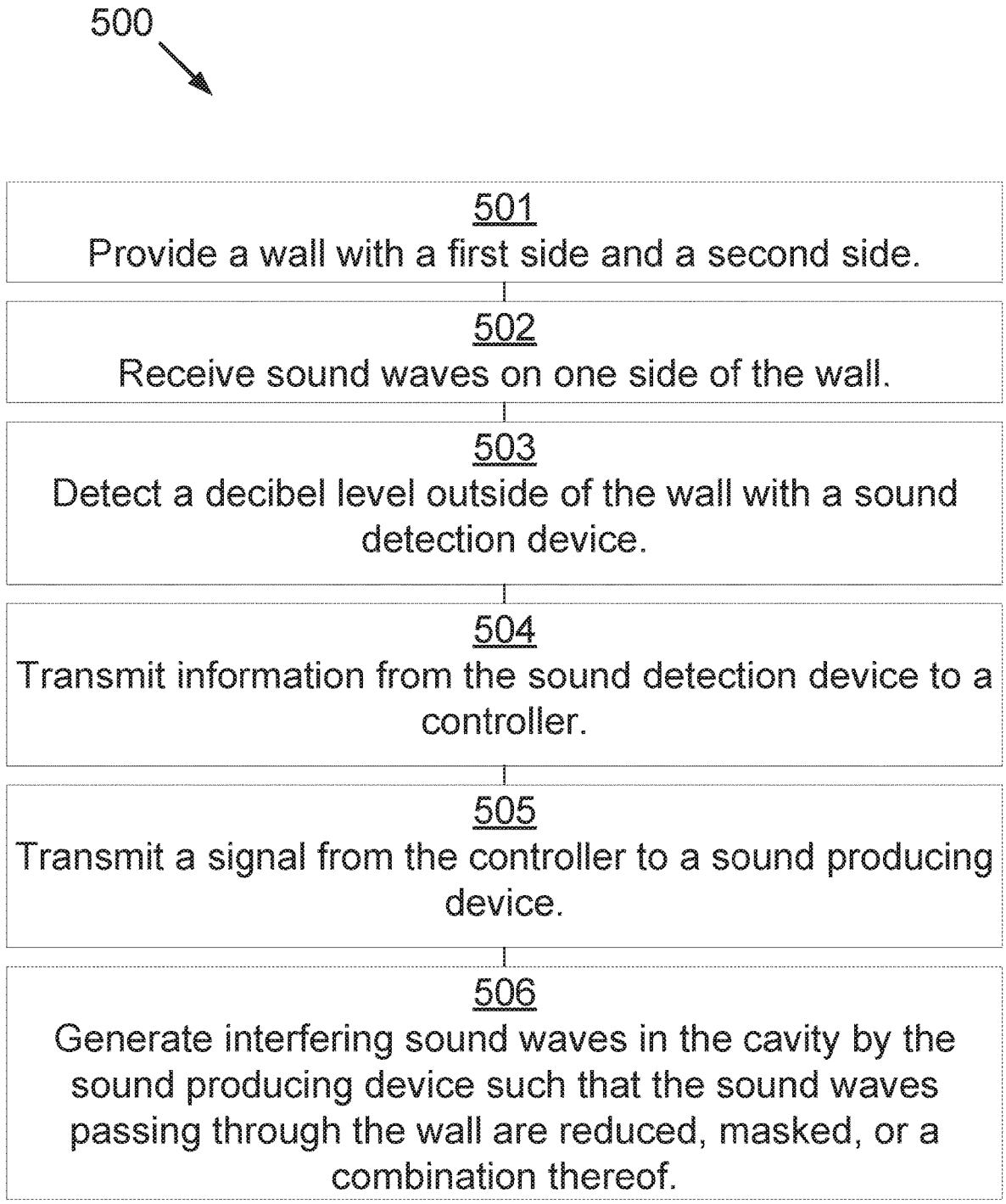
FIG. 5 is a block diagram showing a method for modifying sound waves passing through a wall.

Now referring to FIG. 5, FIG. 5 is a block diagram showing a method for modifying sound waves passing through a wall that may be used in one embodiment of the present invention. At 501, a wall is provided with a first side and a second side. The wall has a cavity between the first side and the second side. At 502, sound waves are received on one side of the wall. At 503, a sound detection device detects a decibel level outside of the wall. At 504, information from the sound detection device is transmitted to a controller. At 505, a signal from the controller is transmitted to a sound producing device. At 506, interfering sound waves are generated by the sound producing device in the cavity such that the sound waves passing through the wall are reduced, masked, or a combination thereof. The sound waves are modified based on the decibel level.

In some embodiments, the wall is retractable into the ceiling, an adjacent wall, or the floor. In some embodiments, the first side and the second side are made of flexible materials. The wall may be retractable by rolling the first side around a first spool and by rolling the second side around the first spool or a second spool.

In some embodiments, the sound producing device is embedded in the floor or the ceiling between the two sides.

In a preferred embodiment, the interfering sound is brown noise (with a spectral density inversely proportional to frequency squared). In a more preferred embodiment, the interfering sound is pink noise (with a spectral density inversely proportional to frequency). In an even more preferred embodiment, the interfering sound is white noise (with a constant spectral density). In a most preferred embodiment, the interfering sound is at a frequency and an amplitude to specifically reduce, mask, or reduce and mask human voices.

In a preferred embodiment, the cavity between the first side and the second side consists of air space. In an alternate embodiment, the cavity is entirely filled with the sound producing device, with no air space between the first side and the second side. In some embodiments, the sound producing device is a piezoelectric vibrator.

The invention has been described with reference to various specific and preferred embodiments and techniques. Nevertheless, it is understood that many variations and modifications may be made while remaining within the spirit and scope of the invention.

What is claimed is:

1. A system for modifying ambient sound waves passing through a wall comprising:

the wall comprising a first side and a second side with a cavity therebetween;

a sound producing device, situated between the first side and the second side, and configured to produce interfering sound waves in the cavity, such that the ambient sound waves passing through the wall are reduced, masked, or reduced and masked; and wherein the wall is retractable into a ceiling, into an adjacent wall, or into a floor.

2. The invention of claim 1, wherein the first side and the second side both comprise a flexible material, and wherein the wall is retracted by rolling the first side around a first spool and by rolling the second side around the first spool or a second spool.

3. The invention of claim 1, wherein the sound producing device is embedded in a floor between the first side and the second side.

4. The invention of claim 1, wherein the sound producing device is embedded in a ceiling between the first side and the second side.

5. The invention of claim 1, comprising a plurality of sound producing devices, wherein the plurality of sound producing devices are attached within the cavity to either the first side, the second side, or both the first side and the second side.

6. The invention of claim 5, wherein the plurality of sound producing devices occupy all of the cavity.

7. The invention of claim 1, wherein the interfering sound is at a frequency and an amplitude that reduces, masks, or reduces and masks human voices.

8. The invention of claim 1, further comprising:

a sound detection device configured to detect a decibel level, a sound frequency, or the decibel level and the sound frequency outside of the first side and to transmit information about the decibel level, the sound frequency, or the decibel level and the sound frequency to a controller; and the controller configured to receive the information and send a signal to the sound producing device, the signal instructing the sound producing device to modify the interfering sound waves based on the information.

9. The invention of claim 8, wherein the sound detection device comprises a piezoelectric sensor or a microphone.

10. The invention of claim 1, wherein the sound producing device comprises an electrodynamic loudspeaker, a piezoelectric speaker, a flat panel speaker, or a plasma arc speaker.

11. A method for modifying ambient sound waves passing through a wall comprising:

providing a wall with a first side and a second side, with a cavity therebetween;

receiving the ambient sound waves on one side of the wall;

generating interfering sound waves by a sound producing device in the cavity such that the ambient sound waves passing through the wall are reduced, masked, or reduced and masked; and retracting and deploying the wall into and out of a ceiling, an adjacent wall, or a floor.

12. The invention of claim 11, wherein the first side and the second side both comprise a flexible material, and wherein the wall is retracted by rolling the first side around a first spool and by rolling the second side around the first spool or a second spool.

13. The invention of claim 11, wherein the interfering sound is at a frequency and an amplitude that reduces, masks, or reduces and masks human voices.

14. The invention of claim 11, further comprising:

detecting a decibel level, a sound frequency, or the decibel level and the sound frequency outside of the wall with a sound detection device;

transmitting information from the sound detection device to a controller, the information comprising the decibel level, the sound frequency, or the decibel level and the sound frequency;

transmitting a signal from the controller to the sound producing device based on the information; and modifying the interfering sound waves based on the information.

15. A system for modifying ambient sound waves passing through a wall comprising:

the wall with a first side and a second side with a cavity therebetween;

a first sound detection device configured to detect a first decibel level, a first sound frequency, or the first decibel level and the first sound frequency outside of the first side and to transmit first information about the first decibel level, the first sound frequency, or the first decibel level and the first sound frequency to a controller and a second sound detection device configured to detect a second decibel level, a second frequency, or the second decibel level and the second frequency outside of the second side and to transmit second information about the second decibel level, the second sound frequency, or the second decibel level and the second sound frequency to the controller; and the controller configured to receive the first information and the second information and send a signal to a sound producing device based on the first information and the second information;

the sound producing device, situated between the first side and the second side, configured to receive the signal and to produce interfering sound waves in the cavity based on the first information and the second information such that ambient sound waves passing through the wall are reduced, masked, or a combination thereof.

16. The invention of claim 15, wherein the sound producing device comprises an electrodynamic loudspeaker, a piezoelectric speaker, a flat panel speaker, or a plasma arc speaker.

17. The invention of claim 15, wherein the sound detection device comprises a piezoelectric sensor or a microphone.

18. The invention of claim 15, wherein the sound producing device occupies all of the cavity.

* * * * *